US008434762B1

(12) United States Patent
Kerpovich

(10) Patent No.: US 8,434,762 B1
(45) Date of Patent: May 7, 2013

(54) AIR TABLE GAME ASSEMBLY

(76) Inventor: Theodore Kerpovich, Kingston, PA (US)

( * ) Notice: Subject to any disclaimer, the term of this patent is extended or adjusted under 35 U.S.C. 154(b) by 0 days.

(21) Appl. No.: 13/438,839

(22) Filed: Apr. 3, 2012

(51) Int. Cl.
*A63F 7/07* (2006.01)

(52) U.S. Cl.
USPC ..... 273/126 A; 273/108.1; 273/108.5

(58) Field of Classification Search ..... 273/108, 273/108.1, 108.5, 108.57, 126 R, 126 A, 273/118 R, 118 A, 119 R, 119 A
See application file for complete search history.

(56) References Cited

U.S. PATENT DOCUMENTS

| | | | | |
|---|---|---|---|---|
| 3,391,933 | A | 7/1968 | Cooper | |
| 3,954,256 | A | 5/1976 | Keijzer et al. | |
| 4,014,543 | A | 3/1977 | Arad | |
| 5,046,734 | A | 9/1991 | Laine | |
| 5,556,094 | A | 9/1996 | Shiledar Baxi | |
| D408,463 | S | 4/1999 | Yamada | |
| 7,108,262 | B2 * | 9/2006 | Giegerich | 273/108 |
| 7,389,987 | B1 | 6/2008 | Paukert | |
| 8,025,293 | B1 * | 9/2011 | Crawford et al. | 273/126 A |
| 8,336,880 | B2 * | 12/2012 | Crawford et al. | 273/126 A |
| 2005/0161878 | A1 | 7/2005 | Nally et al. | |
| 2006/0202414 | A1 * | 9/2006 | Chen | 273/108.1 |
| 2008/0073839 | A1 * | 3/2008 | Nally | 273/126 R |
| 2010/0201067 | A1 * | 8/2010 | Liao | 273/108.1 |
| 2011/0233860 | A1 * | 9/2011 | Crawford et al. | 273/108.57 |

* cited by examiner

*Primary Examiner* — Raleigh W Chiu

(57) ABSTRACT

An air table game assembly has a platform. Outer sections of the platform have a perimeter edge and an interior side with the interior side being adjacent to a central section. A border wall extends around the perimeter edge of each outer section. Openings in the border wall define goals positioned in each of the outer sections. A first barrier is pivotable between a retracted position and a deployed position. The first barrier extends across a first one of the outer sections defining a first excluded section when in the deployed position. A bottom panel is coupled to the border wall in spaced relationship to the platform to define an air chamber. A plurality of vents extends through the platform and a blower is coupled to the bottom panel. The blower urges air through the vents in the platform.

10 Claims, 5 Drawing Sheets

AIR TABLE GAME ASSEMBLY

BACKGROUND OF THE DISCLOSURE

Field of the Disclosure

The disclosure relates to air table game devices and more particularly pertains to a new air table game device for providing adjustability of the game surface to permit play by two to four players at one time.

SUMMARY OF THE DISCLOSURE

An embodiment of the disclosure meets the needs presented above by generally comprising a platform having a central section and outer sections extending from the central section. Each outer section has a perimeter edge and an interior side with the interior side being adjacent to the central section. A border wall is coupled to and extends around the perimeter edge of each of the outer sections of the platform defining a playing surface. A plurality of openings in the border wall define goals positioned along a distal edge of each of the outer sections relative to the central section. A first barrier is pivotally coupled to the border wall and pivotable between a retracted position and a deployed position. The first barrier extends across a first one of the outer sections defining a first excluded section when the first barrier is in the deployed position. A bottom panel is coupled to the border wall in spaced relationship to the platform to define an air chamber. A plurality of vents extends through the platform and a blower is coupled to the bottom panel. The blower urges air through the vents in the platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
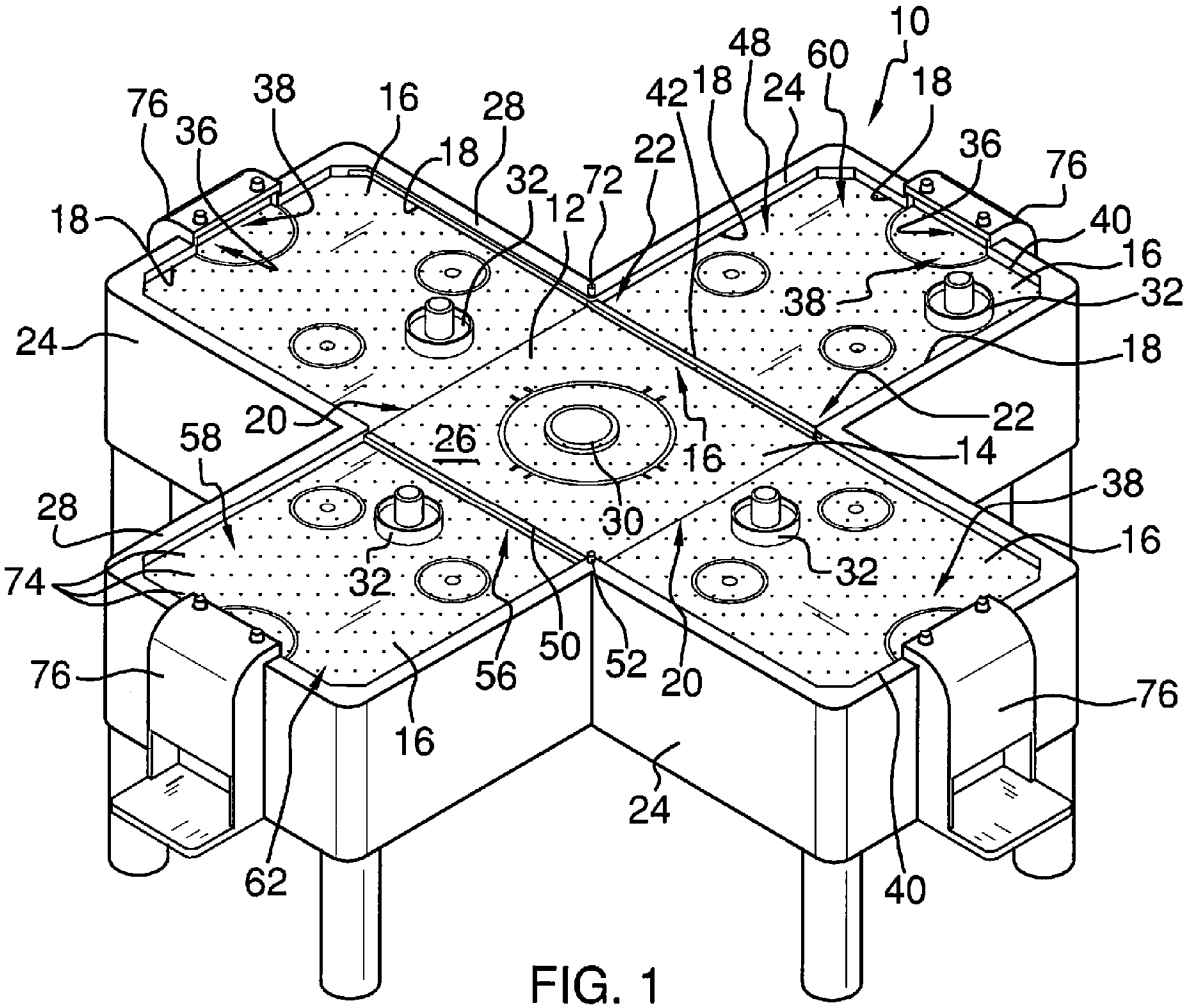
FIG. 1 is a top front side perspective view of a air table game assembly according to an embodiment of the disclosure.
Figure 2:
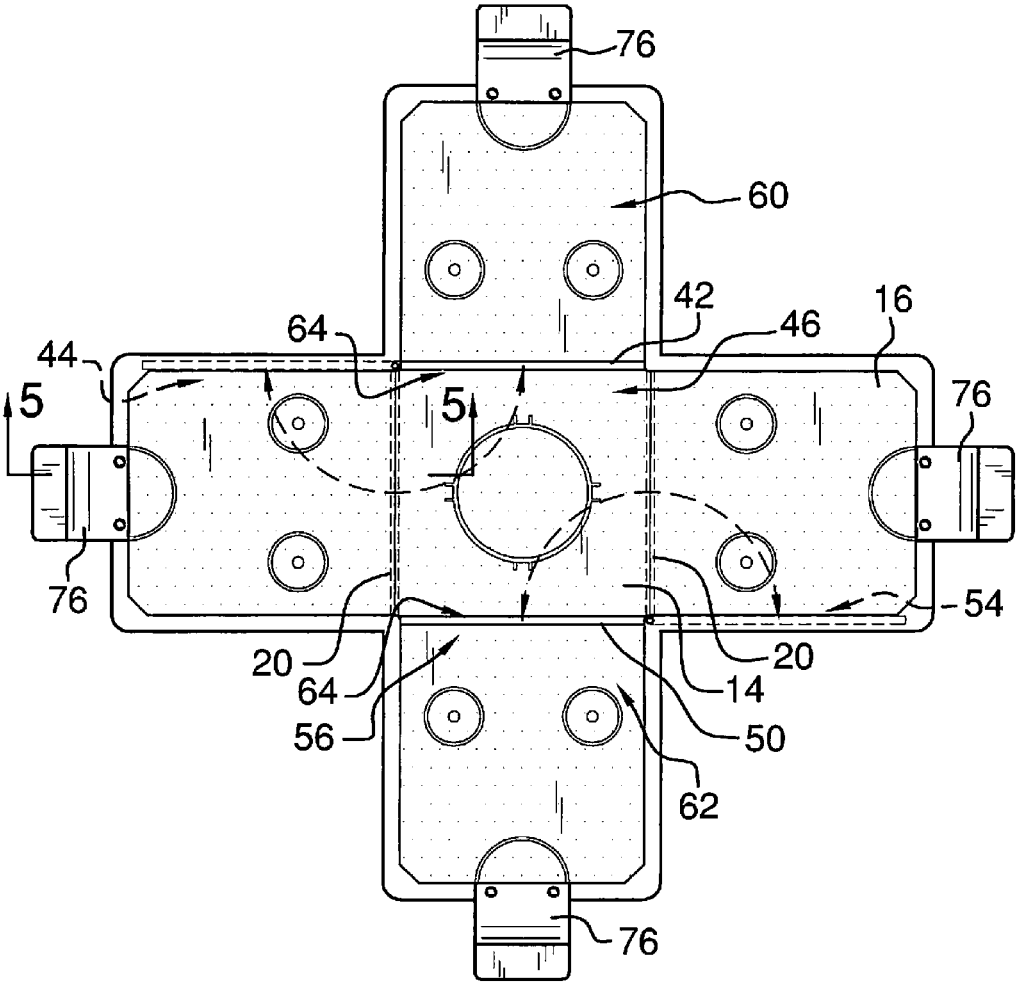
FIG. 2 is a top view of an embodiment of the disclosure.
Figure 3:
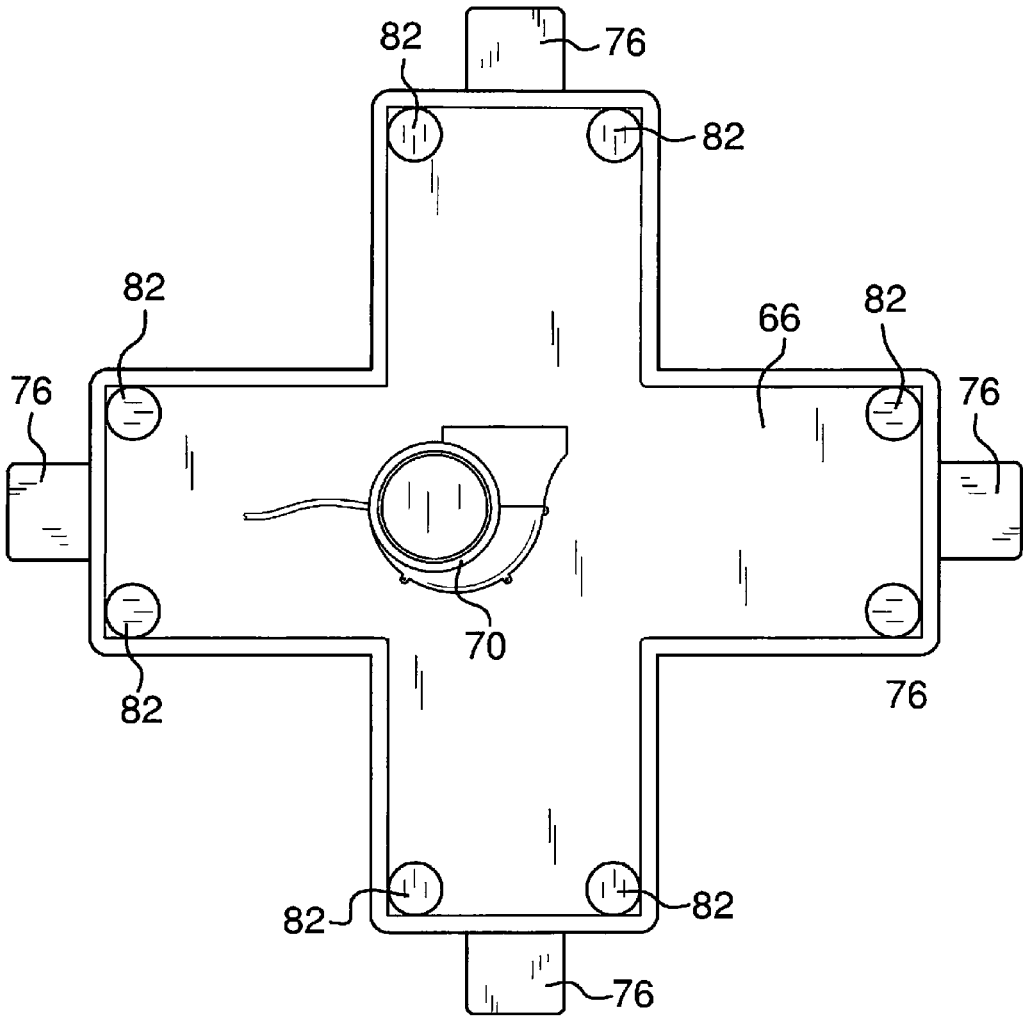
FIG. 3 is a bottom view of an embodiment of the disclosure.
Figure 4:
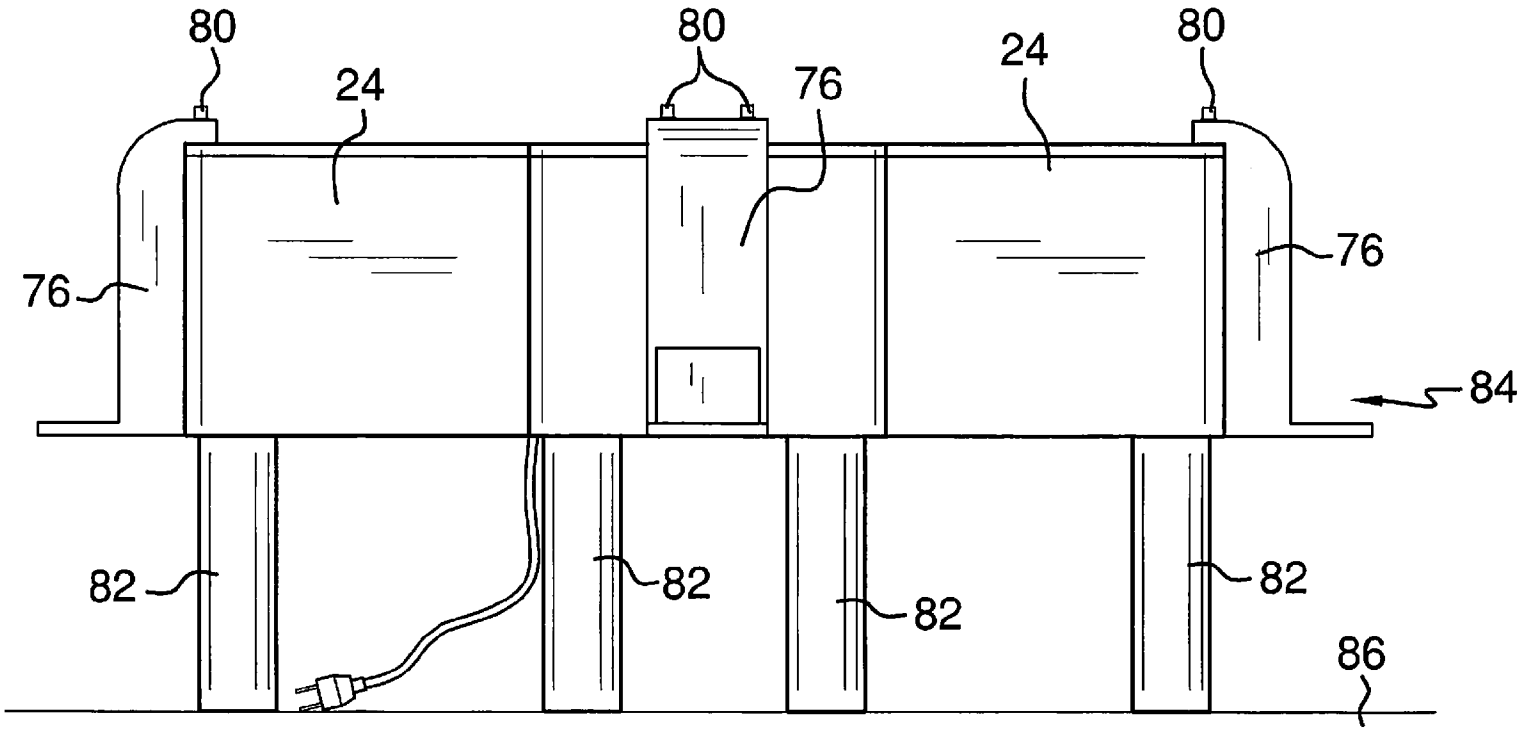
FIG. 4 is a side view of an embodiment of the disclosure.
Figure 5:
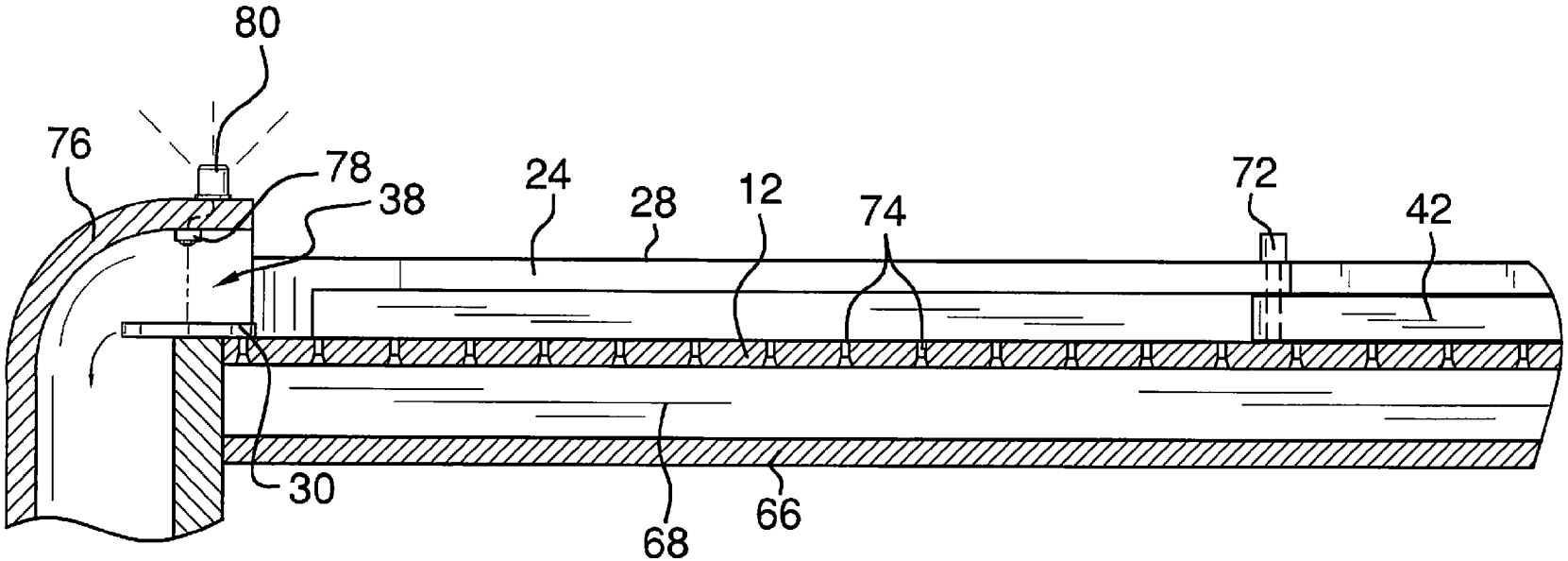
FIG. 5 is a cross-sectional view of an embodiment of the disclosure taken along line 5-5 of FIG. 2.

With reference now to the drawings, and in particular to FIGS. 1 through 5 thereof, a new air table game device embodying the principles and concepts of an embodiment of the disclosure and generally designated by the reference numeral 10 will be described.

As best illustrated in FIGS. 1 through 5, the air table game assembly 10 generally comprises a platform 12 having a central section 14 and a plurality of outer sections 16 extending from the central section 14. Each outer section 16 has a perimeter edge 18 and an interior side 20 extending between opposite ends 22 of the perimeter edge 18. The interior side 20 of each outer section 16 is adjacent to the central section 14. A border wall 24 is coupled to and extends around the perimeter edge 18 of each of the outer sections 16 of the platform 12 defining a playing surface 26. A top edge 28 of the border wall 24 is positioned in horizontally spaced relationship to the platform 12 such that the border wall 24 surrounds the playing surface 26. A plurality of openings 36 is positioned in the border wall 24. Each opening 36 defines a goal 38 positioned along a distal edge 40 of an associated one of the outer sections 16 relative to the central section 14. Thus, a disc 30 may be positioned on the platform 12 and struck with a mallet 32. The disc 30 will ricochet off of the border wall 24 simulating the game of ice hockey.

A first barrier 42 is pivotally coupled to the border wall 24 by a first pin 72. The first barrier 42 is pivotable between a retracted position 44 and a deployed position 46. The first barrier 42 extends across a first one 48 of the outer sections 16 defining a first excluded section 60 when the first barrier 42 is in the deployed position 46. The first barrier 42 is recessed into the border wall 24 when the first barrier 42 is in the retracted position 44. Similarly, a second barrier 50 is pivotally coupled to the border wall 24 by a second pin 52. The second barrier 50 is pivotable between a retracted position 54 and a deployed position 56. The second barrier 50 extends across a second one 58 of the outer sections 16 defining a second excluded section 62 when the second barrier 50 is in the deployed position 56. The first excluded section 60 is aligned with the second excluded section 62. The first excluded section 60 and the second excluded section 62 extend from opposite sides 64 of the central section 14. The second barrier 50 may also be recessed into the border wall 24 when the second barrier 50 is in the retracted position 54.

A bottom panel 66 is coupled to the border wall 24 positioned in spaced relationship to the platform 12 defining an air chamber 68 therebetween. A blower 70 is coupled to the bottom panel 66 such that the blower 70 urges air into the air chamber 68. A plurality of vents 74 extends through the platform 12. Each of the vents 74 is in fluid communication with the air chamber 68 whereby the blower 70 urges air through the vents 74 in the platform 12 supporting the disc 30 over the platform 12 enhancing gliding of the disc 30 on the playing surface 26.

A plurality of chutes 76 is provided. Each chute 76 is coupled to the border wall 24 adjacent to an associated one of the goals 38. Thus, each chute 76 is configured for receiving the disc 30 passing through the associated one of the goals 38. A plurality of sensors 78 are provided. Each sensor 78 is coupled to an associated one of the chutes 76 adjacent to the associated goal 38. Each sensor 78 is configured for detecting when the disc 30 passes through the associated goal 38 into the associated chute 76. A plurality of lights 80 may also be provided. Each light 80 is coupled to an associated one of the chutes 76 and operationally coupled to the associated sensor 78 of the associated chute 76. Each light 80 is configured to illuminate when the disc 30 passes through the associated goal 38 into the associated chute 76. A scorekeeping system may also be employed and operationally coupled to the sensors 78 and lights 80.

The platform 12 may be provided for positioning on an existing tabletop. Alternatively, a plurality of legs 82 is coupled to the platform 12 by way of attachment to either the bottom panel 66 or the border wall 24. The legs 82 extend downwardly from the platform 12 whereby the platform 12 is supported in an elevated position 84 over a supporting surface 86.

In use, the first barrier 42 and second barrier 50 are positioned as desired depending on the total number of players. For four players, each of the first barrier 42 and the second barrier 50 is retracted opening up the full playing surface 26 and providing access to all of the goals 38 from the central section 14 of the platform 12. One of the first barrier 42 and the second barrier 50 may be deployed to provide for three players, and both may be deployed to provide for a conventional two player air hockey game.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An air table game assembly comprising:

a platform having a central section and a plurality of outer sections extending from said central section, each outer section having a perimeter edge and an interior side extending between opposite ends of said perimeter edge, said interior side of each outer section being adjacent to said central section;

a border wall coupled to and extending around said perimeter edge of each of said outer sections of said platform defining a playing surface;

a plurality of openings in said border wall, each opening defining a goal positioned along a distal edge of an associated one of said outer sections relative to said central section;

a first barrier pivotally coupled to said border wall, said first barrier being pivotable between a retracted position and a deployed position, said first barrier extending across a first one of said outer sections defining a first excluded section when said first barrier is in said deployed position;

a bottom panel coupled to said border wall, said bottom panel being positioned in spaced relationship to said platform defining an air chamber;

a plurality of vents extending through said platform; and a blower coupled to said bottom panel, said blower urging air through said vents in said platform.

2. The assembly of claim 1, further including a plurality of chutes, each chute being coupled to said border wall adjacent to an associated one of said goals whereby each chute is configured for receiving a disc passing through said associated one of said goals.

3. The assembly of claim 2, further including a plurality of sensors, each sensor being coupled to an associated one of said chutes adjacent to said associated goal, each sensor being configured for detecting when the disc passes through said associated goal into said associated chute.

4. The assembly of claim 3, further including a plurality of lights, each light being coupled to an associated one of said chutes, each light being operationally coupled to said associated sensor of said associated chute whereby said light is configured to illuminate when the disc passes through said associated goal into said associated chute.

5. The assembly of claim 1, further including said first barrier being recessed into said border wall when said first barrier is in said retracted position.

6. The assembly of claim 1, further including a second barrier pivotally coupled to said border wall, said second barrier being pivotable between a retracted position and a deployed position, said second barrier extending across a second one of said outer sections defining a second excluded section when said second barrier is in said deployed position.

7. The assembly of claim 6, further including said first excluded section being aligned with said second excluded section, said first excluded section and said second excluded section extending from opposite sides of said central section.

8. The assembly of claim 6, further including said second barrier being recessed into said border wall when said second barrier is in said retracted position.

9. The assembly of claim 1, further including a plurality of legs coupled to said platform, said legs extending downwardly from said platform whereby said platform is supported in an elevated position.

10. An air table game assembly comprising:

a platform having a central section and a plurality of outer sections extending from said central section, each outer section having a perimeter edge and an interior side extending between opposite ends of said perimeter edge, said interior side of each outer section being adjacent to said central section;

a border wall coupled to and extending around said perimeter edge of each of said outer sections of said platform defining a playing surface, a top edge of said border wall being positioned in horizontally spaced relationship to said platform;

a plurality of openings in said border wall, each opening defining a goal positioned along a distal edge of an associated one of said outer sections relative to said central section;

a first barrier pivotally coupled to said border wall, said first barrier being pivotable between a retracted position and a deployed position, said first barrier extending across a first one of said outer sections defining a first excluded section when said first barrier is in said deployed position, said first barrier being recessed into said border wall when said first barrier is in said retracted position;

a second barrier pivotally coupled to said border wall, said second barrier being pivotable between a retracted position and a deployed position, said second barrier extending across a second one of said outer sections defining a second excluded section when said second barrier is in said deployed position, said first excluded section being aligned with said second excluded section, said first excluded section and said second excluded section extending from opposite sides of said central section, said second barrier being recessed into said border wall when said second barrier is in said retracted position;

a bottom panel coupled to said border wall, said bottom panel being positioned in spaced relationship to said platform defining an air chamber, a blower being coupled to said bottom panel such that said blower urges air into said air chamber;

a plurality of vents extending through said platform, each of said vents being in fluid communication with said air chamber whereby said blower urges air through said vents in said platform;

a plurality of chutes, each chute being coupled to said border wall adjacent to an associated one of said goals whereby each chute is configured for receiving a disc passing through said associated one of said goals;

a plurality of sensors, each sensor being coupled to an associated one of said chutes adjacent to said associated goal, each sensor being configured for detecting when the disc passes through said associated goal into said associated chute;

a plurality of lights, each light being coupled to an associated one of said chutes, each light being operationally coupled to said associated sensor of said associated chute whereby said light is configured to illuminate when the disc passes through said associated goal into said associated chute; and a plurality of legs coupled to said platform, said legs extending downwardly from said platform whereby said platform is supported in an elevated position.

* * * * *